United States Patent [19]

Errichiello

[11] 4,294,469

[45] Oct. 13, 1981

[54] BOOK BINDERS AND BOOKS MADE WITH SAID BINDERS

[76] Inventor: Dominic R. Errichiello, 389 Meadowlark Rd., Bloomingdale, Ill. 60108

[21] Appl. No.: 63,859

[22] Filed: Aug. 6, 1979

[51] Int. Cl.[3] ..... B42F 15/04

[52] U.S. Cl. ..... 281/29; 11/1 C; 11/3; 281/31; 402/75; 402/80 P

[58] Field of Search ..... 402/73, 74, 76, 75, 402/80 P; 281/25, 26, 29, 33, 35, 36, 37, 49, 34, 1, 31; 40/373, 537; 11/1 C, 3

[56] References Cited

U.S. PATENT DOCUMENTS

| | | | |
|---|---|---|---|
| 3,201,145 | 8/1965 | Libby | 281/37.5 |
| 3,353,844 | 11/1967 | Staats | 402/75 X |
| 3,491,196 | 1/1970 | Stein | 40/537 X |
| 4,073,612 | 2/1978 | Nitta | 40/373 X |

FOREIGN PATENT DOCUMENTS

| | | | |
|---|---|---|---|
| 1030266 | 5/1966 | United Kingdom | 281/29 |
| 1541500 | 11/1977 | United Kingdom | 281/29 |

*Primary Examiner*—Paul A. Bell
*Assistant Examiner*—John S. Brown
*Attorney, Agent, or Firm*—Keil & Witherspoon

[57] ABSTRACT

Book binders and books made with said binder, said binders comprising integral moldings of a spine having a substantially planar, longitudinal panel and a front cover panel and a rear cover panel respectively hingedly mounted on opposite, longitudinal sides of said spine; paper pages positioned in said binder between said cover panels, and one edge of said pages being fastened by staples or stitching to said planar panel in said spine; a rectangular, longitudinal cavity in the outer, rear face of said spine, the bottom wall of said cavity being said substantially planar panel, and a rectangular spine insert of mating dimensions with said cavity being mounted in said cavity and covering the bottom wall and any parts of said stitching or stapling which are exposed on said planar panel.

4 Claims, 4 Drawing Figures

FIG. 2
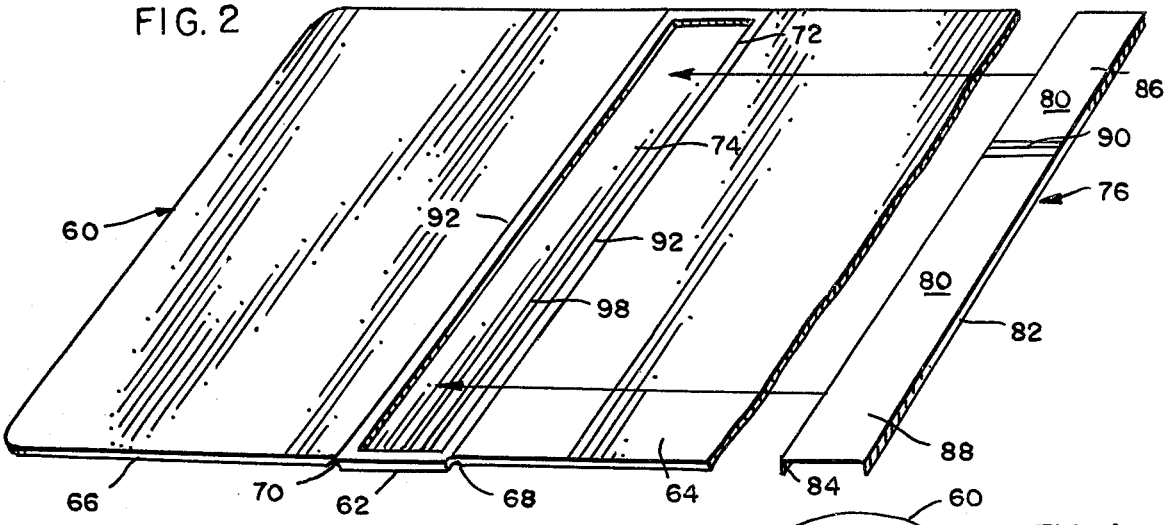
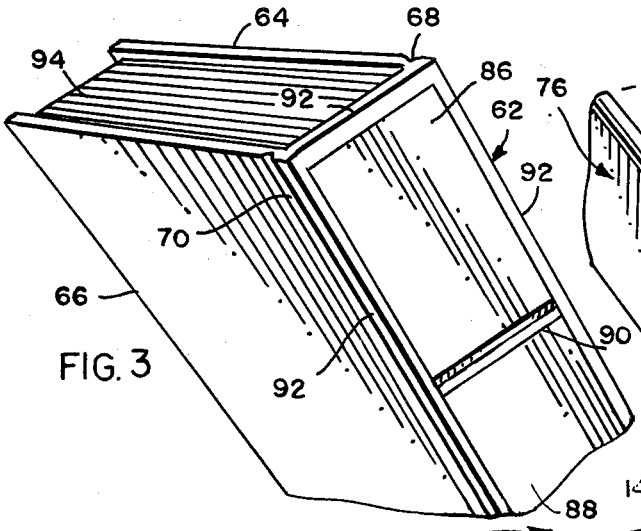
FIG. 3
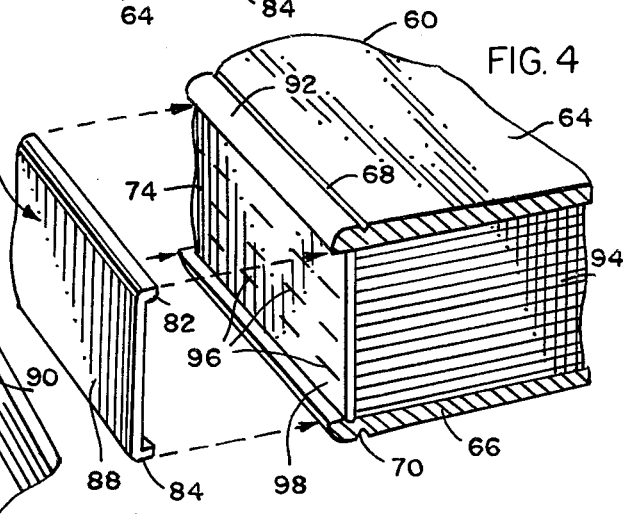
FIG. 4
FIG. 1
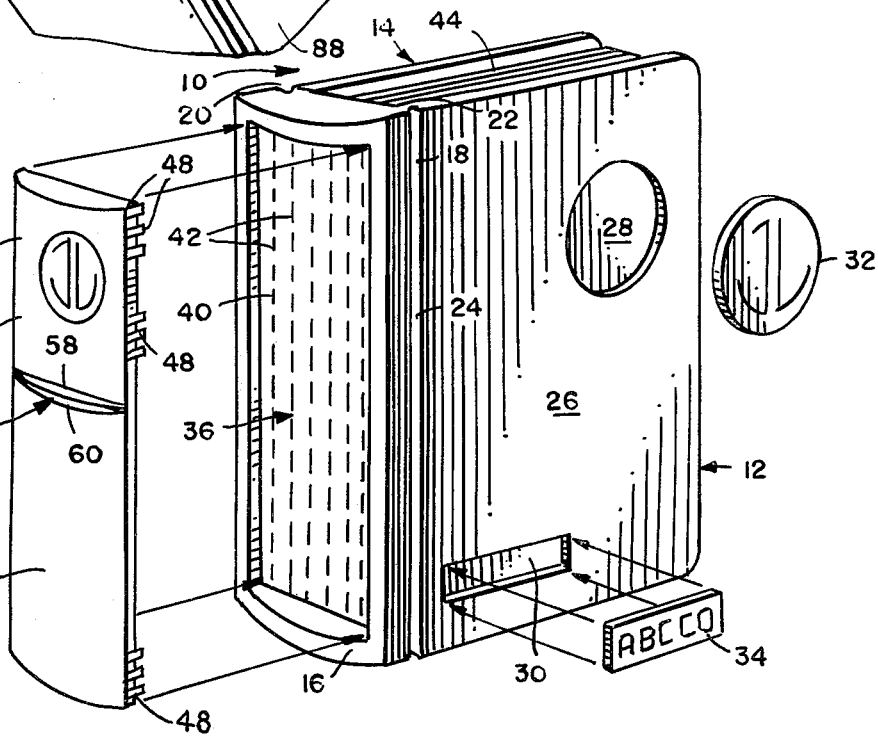

BOOK BINDERS AND BOOKS MADE WITH SAID BINDERS

BACKGROUND AND BRIEF DESCRIPTION OF THE INVENTION

The subject invention pertains to new innovations in book binders and books made therewith. These book binders depart from known binder structures and concepts in several ways. First, the spine and the front and rear cover panels are an integral molding of a thermoplastic polymer, preferably low density polypropylene or polypropylene/polyethylene copolymers or mixtures. These polymers offer the advantage of forming living hinges by molding lines of weakness, e.g., a groove or two opposed grooves in the plastic matrix, and flexing the molding along the lines of weakness while it is still hot to cause molecular orientation of the polymer at the lines of weakness.

Second, the major part of the spine is a relatively thin, longitudinal, substantially planar panel extending transversely substantially the full distance between said cover panels when they are parallel and at right angles to the spine. Such spine then serves as the member to which the pages of the book are bound by fastening means, e.g., an adhesive but more preferably stitching or staples.

Almost all books with hard covers are bound by printing two, side-by-side pages of the book on one or both sides of a paper sheet, which is then folded vertically midway between the side-by-side printed pages. A number of these folded sheets are assembled in page number sequence, and the group of sheets are stitched at their collective fold lines to a spine backing by a vertical stitching line. Then another group of folded sheets, again with numerical page sequence, are assembled and stitched at their collective fold lines to the spine backing in a vertical line stitching next to the first stitch line. This process usually is repeated at least several more times until all pages have been stitched to the spine backing.

Third, the exposed, rear face of the spine has a large, longitudinal, shallow cavity, the bottom wall of which is the aforesaid panel to which the folded pages of the book are fastened. A molded spine insert can be press-fitted or otherwise mounted in the cavity to cover the exposed lines of stitching or the exposed parts of the staples lying in the cavity.

RELATED APPLICATION

Certain of the new innovations disclosed in my copending application Ser. No. 63,863, filed Aug. 6, 1979, and incorporated herein by reference, can be used to advantage in the subject invention, which involves integrally molded book binders having a substantially planar, longitudinal, spine and a front cover panel and a rear cover panel respectively hingedly mounted on opposite, longitudinal sides of said spine.

Also, the employment of one piece moldings of the front and rear cover panels, connected by integrally molded living hinges to opposite longitudinal edges of the spine, can simplify the manufacture of the spine, the cover panels and the covering of said spine and panels with sheeting of the desired color and bearing the desired lettering and other markings on the spine, front cover panel and/or rear cover panel.

Still further, another innovation involves the longitudinal, vertical, shallow cavity in the rear, outer face of the spine and a removable, press-in or snap-in spine insert or a fixed spine insert, which inserts are glued, heat-sealed, press-fitted, or snap-fitted in the cavity. One size and style of the integral molding of the covers and spine can serve the needs of many purchasers of the books or the binders per se because different legends, indicia, logos, etc. can be printed, embossed, raised, etc. on the inserts, which can be customized for each purchaser.

Optionally, a further innovation involves also the spine insert, which, when formed as a molding of a thermoplastic polymer, may have a transverse, horizontal, living hinge which allows the lower segment of the insert to swing outwardly about 20° to 40° relative to the general plane of the spine. This feature allows the lower segment to act as an easel-like stand for standing the open book at a vertically and rearwardly sloping pitch to make reading the pages, e.g., as in a cookbook, easier to read while following the recipe.

A further innovation involves the front cover panel, the front face of which preferably has one large shallow cavity or two or more smaller, shallow cavities. Thin, mating, insert panels or sheets, customized to the needs and devices of each purchaser by the printing, embossments, raised indicia, etc. on a given set of insert panels, are pressed fitted, glued, heat-sealed, etc., in the shallow cavity.

PRIOR ART

The most common method of mounting stitched or stapled, bound pages of a book in the outer covering—the binder composed of front and rear cover panels and the spine—is to attach relatively heavy, outermost sheets of the bound pages to the inside faces of the front and rear cover panels. The sheets which hold the bound pages in the binder are respectively once-folded sheets with one "page" in the binding and the other "page" secured to the inside face of the cover panel—the fold serving as the hinge between the bound pages and the respective cover panels. Books which are used repeatedly, e.g., library books, reference books, dictionaries, cook-books, manuals, etc. tend ultimately to tear at the fold and then either require a new binder or other remedial means to re-bind the pages in the binder.

Further, in making these prior art binders, the assembly of the components of the books involves a number of steps, even with sophisticated machinery. For example, paperboard or cardboard panels and the spine strip must be fed and carefully positioned before they are covered by the vinyl sheet or other covering material. The latter must be wrapped over the marginal edges of the panels and tucked or folded around two outside covers of each panel. The covering sheet must be smoothly adhered to one or both faces of the panel and the back of the spine strip. Relatively complicated and expensive machinery useful only for making books with a particular size and shape of the front and rear cover panels is required in an automated operation.

Further, the usual paperboard or cardboard panels are moisture susceptible and often warp within a short time span. Also the cover sheet sometimes works loose from the spine, particularly at the ends of the spine.

Exemplary printed prior art is found in U.S. Pat. Nos. 3,168,424 (integral plastic sheets adhered on cover panels and spine); 4,011,940 (living hinges); 3,201,145 (molded plastic binders with living hinges) and 3,088,253 (cast plastic book covers).

A preferred embodiment of the invention is shown in the drawings, wherein:

FIG. 1 is a perspective, exploded view of the closed, bound book, with a transversely curved, spine insert; and FIG. 2 is a perspective, exploded view of the outside faces of the binder in open position with a flat or planar spine insert having an easel-like stand and the cover panels laid flat;

FIG. 3 is a fragmentary, perspective view of a book having the binder of FIG. 2; and FIG. 4 is a fragmentary, perspective exploded view of the book of FIG. 3 with the spine panel separated from the spine.

Referring to the drawings, the book binder 10 comprises a front cover panel 12, a rear cover panel 14 and a spine 16 molded integrally from a thermoplastic polymer molding composition, preferably of a thermoplastic polymer which becomes molecularly oriented when the integrally formed hinges (weak zones) are flexed several times while the molding is still hot. Such polymers include polypropylene and polypropylene/polyethylene mixtures or copolymers. The hinge which results at the weakened zone is virtually free from cracking or tearing and is known in the art as a "living hinge".

Referring to FIG. 1, the living hinges 18 and 20 are formed at the junctures of the spine 16 and the front and rear cover panels 12 and 14 by the opposed V-notches 22 and 24 which leave a narrow neck of thermoplastic material which is the weakened zone at which the aforesaid flexing occurs, thereby integrally hinging the two cover panels 12,14 along the opposed longitudinal edges of the spine 16.

The front face 26 of the front panel 12 has a circular, shallow cavity 28 and a rectangular, shallow cavity 30 therein. These cavities respectively receive a separately molded, thin disc insert 32 and a rectilinear, thin insert 34. Each insert bears printing, indicia, logos, designs, symbols, etc. customized to suit the needs and desires of the publisher or the ultimate customer-user or the customer-retailer for the books. Thus, the basic unit consisting of the spine and the two cover panels with or without inserts in the front panel can be used as the basic components for customized books of many divergent ultimate customers or users. Examples of the latter are manufacturers and/or distributors who use bound books as catalogs, manuals, promotions, sales aids, etc. for their goods. Similar uses by enterprises in the service fields include those of insurance companies, public libraries, medical libraries, science libraries, utilities, household and office maintenance services, instruction services, such as cooking recipes, and a host of others. In every instance, a given run of books can be one color or one of a variety of color combinations and individually customized with particular, individualized, embossed, flat or planar lettering, designs, logos, etc. for a particular customer or user by simply changing the mold for the inserts. Similarly, books in school libraries or sold at stores servicing high school students, university or college students, trade school students and the like can have inserts which reflect the name, mascot, seal, or other insignia for any given institution of learning. The most in special molding die costs chargeable to each customer for individualized books would be the die costs for the inserts and for the hereinafter described spine insert, if the latter is also customized.

The spine 16 has a large, shallow, rectangular cavity 36 into which is press-fitted a rectangular, spine insert 38. The bottom wall 40 of the cavity has stitching 42 used to mount the book pages 44 in the binder. One or more holes may be provided to receive buttons on the spine insert 38 to mount it in cavity 36. It is preferred, however, that the spine insert 38 be press-fitted in the cavity 36. Small, thin ribs 48 on the longitudinal edges of the spine insert preferably are employed to assure a tight press fit in the cavity.

The spine insert may be a one piece, solid molding with or without lettering, indicia, symbols, logos, etc., thereon, or, in the illustrated embodiment, may be a molding subdivided into an upper segment 52 which is tightly fitted into the upper part of the cavity 36 and a lower segment 54, which is hingedly connected by the integral plastic hinge 56. The lower segment normally rests in the cavity 36 and is frictionally but removably held therein by the ribs 48 on opposite, lower, longitudinal edges of the lower segment 54. The latter can swing at fixed degrees (normally in the range of about 20° to 40°, preferably about 30°) away from the bottom wall 40 of the cavity until its swing is arrested when the two faces 58 and 60 of the hinge V-notch come into face-to-face contact. In this position, the angulated lower segment 54 can serve as an easel-like stand or brace to hold the open book in a diagonally upstanding posture. If desired, the lower segment 54 may have a knob or button (not shown) to grip when pivoting the segment out of the cavity 36.

The front face 26 of the front cover panel 12 may have, instead of small cavities 28,30, a large rectangular, shallow recess and a mating, molded, rectangular, thin insert panel. The desired lettering, indicia, symbols, logos, etc. 68 and 70 may be embossed, flat printed or raised on the face of the rectangular panel itself or may in turn be on inserts placed in cavities or holes in the insert panel. To mask the parting line between the face 26 and insert panel a thin, narrow, raised rib (not shown) may be provided around the periphery of the insert panel or the cavity.

The transversely arcuate (convexly rounded) rear face of the spine is attained simply by providing for such contour in the spine and spine insert molds. However, if desired, the rear face may be flat or even transversely concavely rounded. Ribbing or other decorative geometry may be readily obtained via the molds' contours.

Referring now to FIGS. 2–4, the book binder 60 comprises an integral molding of a thermoplastic polymer, preferably low density polypropylene or polypropylene/polyethylene mixtures or copolymers, wherein the spine 62 has the front cover panel 64 and the rear cover panel 66 hingedly connected to opposite longitudinal edges of the spine by living hinges 68 and 70. The outer, rear face 72 of the spine has a longitudinal, rectangular cavity 74 in which is press-fitted or glued the spine insert 76. The spine insert 76 is a thermoplastic polymer molding having a planar, rear, medium strip 80 with longitudinal, right angular lips 82,84. The insert 76 is divided into an upper segment 86 and a lower segment 88 connected by a horizontal transverse living hinge 90, whereby the latter can be swung away from the cavity at an angle of 20°–40° and serve as an easel-like stand for the open book. As in FIG. 1, the upper segment 86 is press-fitted or glued tightly in the upper part of the cavity 74 while the lower segment 88 is tightly but removably, frictionally fitted into the cavity 74. The outer face of the median strip 80 is substantially flush with the rear surfaces of the marginal edge parts 92 of the spine. Lettering, indicia, etc. may be applied directly on the outer face(s) of the front and rear cover panels and/or the outer, rear faces 80 of the segments 86,88 of the spine insert 76, or these faces may have shallow cavities of the type discussed above in reference to FIG. 1 for inserting indicia-bearing front cover inserts.

The paper pages 94 of the books are mounted in the binders 10 and 60 by using pairs of page sheets with a 180° fold between each pair of page sheets. A group of folded pairs of sheets are nestled together to form a bundle of successively interleaved folded pairs with the folds overlying one another. Stitching 96 or stapling or other fastening means is applied through the stacked fold lines and through the thin wall 98, which is the cross wall of the spine 16 and the bottom wall of the rectangular, shallow cavity 74. It will be readily appreciated that the exposed parts of the stitching 96 or of other fastening means lying in the cavity 74 is covered and hidden from view by the spine inserts 38 and 76.

It will be appreciated that the spine inserts 38 and/or 76 may be one piece moldings wherein there is no living hinge in the insert and no easel-like stand 88.

It will be appreciated from the foregoing that the book binders of the invention herein can take many forms other than the preferred forms shown in the drawings and that the invention as herein claimed is not limited to the illustrated embodiments.

I claim:

1. A book comprising an integrally molded binder of a thermoplastic polymer having a spine with a substantially planar, longitudinal panel portion and a front cover panel and rear cover panel respectively hingedly mounted on opposite, longitudinal sides of said spine by means of a living hinge formed between each of said cover panels and respective longitudinal sides of said spine; and paper pages positioned in said binder between said cover panels, one edge of said pages being fastened to said planar panel portion of said spine by means of stitching or stapling extending through said pages and said planar panel portion.

2. A book as claimed in claim 1 further comprising a rectangular, longitudinal cavity formed in the outer, rear face of said spine, the bottom wall of said cavity being said substantially planar panel, and a rectangular spine insert of mating dimensions relative to said cavity mounted in said cavity and covering the bottom wall of said cavity.

3. A book comprising:

an integrally molded binder of a thermoplastic polymer having a spine with a substantially planar longitudinal panel portion and a front cover panel and rear cover panel respectively hingedly mounted on opposite, longitudinal sides of said spine by means of a living hinge formed between each of said cover panels and respective longitudinal sides of said spine;

and paper pages positioned in said binder between said cover panels, one edge of said pages being fastened to said planar panel portion of said spine by means of an adhesive applied between said pages and said planar panel portion;

and a rectangular longitudinal cavity formed in the outer, rear face of said spine, the bottom wall of said cavity being said substantially planar panel, and a rectangular spine insert of mating dimensions relative to said cavity mounted in said cavity and covering the bottom wall of said cavity.

4. A book comprising:

an integrally molded binder of a thermoplastic polymer having a spine with a substantially planar, longitudinal panel portion and a front cover panel and rear cover panel respectively hingedly mounted on opposite, longitudinal sides of said spine by means of a living hinge formed between each of said cover panels and respective longitudinal sides of said spine;

and paper pages positioned in said binder between said cover panels, one edge of said pages being fastened to said planar panel portion of said spine by means of stitching or stapling extending through said pages and said planar panel portion;

and a rectangular, longitudinal cavity formed in the outer, rear surface of said spine, the bottom wall of said cavity being said substantially planar panel, and a rectangular spine insert of mating dimensions relative to said cavity mounted in said cavity and covering the bottom wall of said cavity.

* * * * *